US009393826B2

(12) United States Patent
Zhou et al.

(10) Patent No.: US 9,393,826 B2
(45) Date of Patent: Jul. 19, 2016

(54) INKJET RECORDING MEDIUM, AND METHOD OF USING THE SAME

(75) Inventors: Xiaoqi Zhou, San Diego, CA (US); Tao Chen, San Diego, CA (US); Eric L. Burch, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 14/353,617

(22) PCT Filed: Oct. 24, 2011

(86) PCT No.: PCT/US2011/057461

§ 371 (c)(1),
(2), (4) Date: Apr. 23, 2014

(87) PCT Pub. No.: WO2013/062510

PCT Pub. Date: May 2, 2013

(65) Prior Publication Data

US 2014/0285569 A1 Sep. 25, 2014

(51) Int. Cl.

| | |
|---|---|
| ***B41M 5/00*** | (2006.01) |
| ***B41M 5/50*** | (2006.01) |
| ***B41M 5/52*** | (2006.01) |
| ***B41J 2/01*** | (2006.01) |
| *B41M 7/00* | (2006.01) |

(52) U.S. Cl.

CPC . *B41M 5/502* (2013.01); *B41J 2/01* (2013.01); *B41M 5/506* (2013.01); *B41M 5/508* (2013.01); *B41M 5/52* (2013.01); *B41M 5/5218* (2013.01); *B41M 7/0081* (2013.01); *B41M 7/009* (2013.01); *B41M 7/0027* (2013.01)

(58) Field of Classification Search

CPC .... B41M 5/506; B41M 5/508; B41M 5/5218; B41M 7/0027; B41M 7/009; B41J 2/01

See application file for complete search history.

(56) References Cited

U.S. PATENT DOCUMENTS

| | | | | |
|---|---|---|---|---|
| 4,832,984 | A * | 5/1989 | Hasegawa et al. | 427/161 |
| 5,022,947 | A | 6/1991 | Hasegawa et al. | |
| 5,059,983 | A * | 10/1991 | Higuma et al. | 428/32.24 |
| 5,500,668 | A | 3/1996 | Malhotra et al. | |
| 5,718,793 | A * | 2/1998 | Inamoto et al. | 156/235 |
| 6,074,761 | A | 6/2000 | Wang et al. | |
| 6,161,929 | A | 12/2000 | Erdtmann et al. | |
| 6,719,422 | B2 | 4/2004 | Wu et al. | |

(Continued)

FOREIGN PATENT DOCUMENTS

JP 2010280201 12/2010

OTHER PUBLICATIONS

Mitsui Chemicals—Grade and Property Information for CHEMIPEARL Polyolefin-based Aqueous Dipersion. Jun. 17, 2015.*

*Primary Examiner* — Betelhem Shewareged

(74) *Attorney, Agent, or Firm* — Dierker & Kavanaugh, P.C.

(57) ABSTRACT

An inkjet recording medium includes a substrate having two opposed surfaces, an ink receiving layer disposed on at least one of the two substrate surfaces, and a porous protective layer disposed on the ink receiving layer. The ink receiving layer receives an ink when printed thereon. The protective layer includes: reactive polymer particles that cross-link upon exposure to microwave radiation; non-reactive polymer particles that coalesce upon exposure to microwave radiation; or a combination of the reactive polymer particles and the non-reactive polymer particles, to form a substantially non-porous protective film that covers the printed ink.

20 Claims, 2 Drawing Sheets

(56) References Cited

U.S. PATENT DOCUMENTS

| | | | |
|---|---|---|---|
| 7,441,886 | B2 | 10/2008 | Chen |
| 7,553,526 | B2 | 6/2009 | Campbell et al. |
| 7,559,643 | B2 | 7/2009 | Chen et al. |
| 7,569,255 | B2 | 8/2009 | Dannhauser et al. |
| 7,582,335 | B2 | 9/2009 | Hunt et al. |
| 7,651,216 | B2 | 1/2010 | Chen et al. |
| 7,651,747 | B2 | 1/2010 | Chen et al. |
| 7,754,296 | B2 | 7/2010 | Khoultchaev et al. |
| 2005/0058784 | A1 | 3/2005 | Kaga |
| 2005/0174415 | A1* | 8/2005 | Chen ..... B41M 5/502 347/105 |
| 2006/0182904 | A1 | 8/2006 | Ushiku et al. |
| 2006/0204685 | A1* | 9/2006 | Missell ..... B41M 5/52 428/32.34 |
| 2010/0068407 | A1 | 3/2010 | Jeremic |
| 2013/0076844 | A1* | 3/2013 | Tombs ..... B41M 5/0011 347/102 |

* cited by examiner

INKJET RECORDING MEDIUM, AND METHOD OF USING THE SAME

BACKGROUND

The present disclosure relates generally to inkjet recording mediums, and to methods of using the same.

Media suitable for use with inkjet printing are often designed to achieve, for example, a desired printing performance and image quality. In some instances, it may also be desirable to produce images with suitable photographic image quality.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in conjunction with other drawings in which they appear.

DETAILED DESCRIPTION

Example(s) of the inkjet recording medium, and example(s) of the method of using the example(s) of the inkjet recording medium, as disclosed herein, may be used to produce a print (i.e., the inkjet recording medium having an ink printed thereon) that exhibits improved photographic image quality (such as, e.g., desirable ink optical density, ink color gamut, gloss level, and/or gloss uniformity), as well as a fast drying time and a suitable resistance to wet smear and/or dry scratching. The examples of the inkjet recording medium disclosed herein include an outermost, porous, protective layer that, when an ink is printed on the medium, enables the vehicle of the ink to be absorbed by an underlying ink receiving layer when the ink is printed on the ink receiving layer. The porous protective layer includes reactive polymer particles, non-reactive polymer particles, or a combination thereof. The reactive and/or non-reactive polymer particles generally define the pore size and pore size distribution of the protective layer.

"Reactive polymer particles" as defined herein are polymer particles that are capable of cross-linking (either via self-cross-linking, e.g., within a single molecule chain and/or among multiple molecule chains; and/or in the presence of a cross-linking agent, e.g., among multiple molecular chains) upon exposure of the medium having the protective layer thereon to microwave radiation. Under suitable conditions, the reactive polymer particles of the protective layer may also coalesce, whereby the reactive polymer particles flow together to form a film, due at least in part to chemical bonding generated in the cross-linking reaction. The cross-linking of the reactive polymer particles (as well as, in some instances, the coalescing thereof) forms a continuous, non-porous/substantially non-porous protective film that covers or physically interlocks the printed/deposited ink.

"Non-reactive polymer particles" as defined herein are polymer particles that do not cross-link during exposure of the medium to the microwave radiation. However, upon exposure to the microwave radiation, the non-reactive polymer particles of the protective layer coalesce, whereby the non-reactive polymer particles flow together to form a film, due at least in part to the rise in temperature such that the temperature is above the glass transition temperature ($T_g$) of the non-reactive polymer particles. The coalescing of the non-reactive polymer particles forms a continuous, non-porous/substantially non-porous protective film that covers or physically interlocks the printed/deposited ink.

Figure 1:
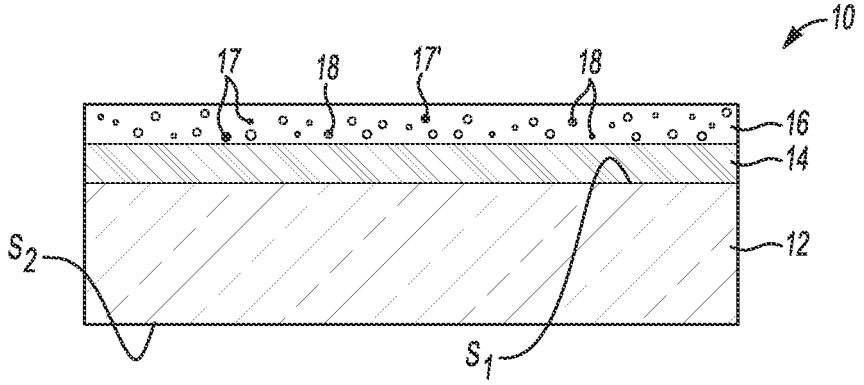
FIG. 1 is a schematic cross-sectional view (which is not drawn to scale) of an example of an inkjet recording medium according to the present disclosure.

Referring now to the figures, an example of the inkjet recording medium 10 is schematically depicted in FIG. 1. The medium 10 generally includes a substrate 12, an ink receiving layer 14 formed on at least one surface (e.g., $S_1$ or $S_2$ alone, or both $S_1$ and $S_2$) of the substrate 12, and a porous protective layer 16 formed on the ink receiving layer 14.

It is to be understood that, as used herein, the terms "formed on", "disposed on", "deposited on", "established on", and the like are broadly defined to encompass a variety of divergent layering arrangements and assembly techniques. These arrangements and techniques include i) the direct attachment of a material layer (e.g., the ink receiving layer 14) to another material layer (e.g., the substrate 12) with no intervening materials layers therebetween, and ii) the attachment of one material layer (e.g., the ink receiving layer 14) to another material layer (e.g., the substrate 12) with one or more material layers therebetween, provided that the one layer being "formed on", "disposed on", "deposited on", or "established on" the other layer is somehow supported by the other layer (notwithstanding the presence of one or more additional material layers therebetween).

Further, the phrases "formed directly on", "disposed directly on", "deposited directly on", "established directly on" and/or the like are broadly defined herein to encompass a situation (s) wherein a given material layer is secured to another material layer without any intervening material layers therebetween. Any statement used herein which indicates that one layer of material is on another layer is to be understood as involving a situation wherein the particular layer that is "on" the other layer in question is the outermost of the two layers relative to incoming ink materials being delivered by the printing system of interest. It is to be understood that the characterizations recited above are to be effective regardless of the orientation of the recording medium materials under consideration.

The substrate 12 for the medium 10 may be chosen from any raw base containing any type of pulp fibers, and may be referred to herein as a pulp-based substrate or a cellulose fiber-based substrate. The substrate 12 may be made from pulp fibers derived from wood, such as from hardwood trees (e.g., deciduous trees (angiosperms) such as birch, oak, beech, maple, and eucalyptus) and/or softwood trees (e.g., coniferous trees (gymnosperms) such as varieties of fir, spruce, and pine, as for example loblolly pine, slash pine, Colorado spruce, balsam fir and Douglas fir), and these pulps may be prepared via any known pulping process. The substrate 12 may also be made from fibers derived from non-wood (such as bagasse, straw, and bamboo) or from recycled fibers. The raw base for the substrate 12 may be made with wood containing fibers such as thermomechanical pulp (TMP) fibers, chemithermomechanical pulp (CTMP) fibers, refiner mechanical pulp fibers (RMP), ground wood (GW) pulp fibers, and/or the like. Further, the raw base may include one or more fillers to control the physical properties of the substrate 12. Examples of fillers include carbonates (e.g., ground calcium carbonate and precipitated calcium carbonate), titanium dioxide, clays (e.g., kaolin clay), silicates, oxides, zeolites, talc, and combinations thereof. The filler may be added to the fiber structure of the raw base, or may be added inside a size/film press.

In an example, the substrate 12 may include some additives, some examples of which include internal sizing agents, dry strengthening agents, wet strengthening agents, pH adjusters, and/or coloring and optical brightness agents. Examples of internal sizing agents include fatty acids, metal salts of fatty acids, alkyl ketene dimmer emulsification products, epoxidized higher fatty acid amides, alkenyl acid anhydride emulsification products and rosin derivatives, alkylsuccinic acid anhydride emulsification products and rosin derivatives, and/or combinations thereof. Examples of dry strengthening agents that may be used include cationic polyacrylamides, amphoteric polyacrylamides, polyvinyl alcohol, cationized starch, vegetable galactomannan, and/or combinations thereof. Wet strengthening agents may, for example, include polyaminepolyamide epichlorohydrin resins. Further, examples of pH adjusters include sodium hydroxide, sodium carbonate, and/or sulfuric acid, and examples of coloring/optical brightness agents include pigments, coloring dyes, and/or fluorescent brighteners.

Other examples of the substrate 12 include coated papers, such as resin-coated papers (e.g., polyolefin co-extruded photobase paper) and papers coated with a layer including inorganic fillers and binders.

In an example, the substrate 12 may be made from, or include any kind of synthetic material, such as polyethylene (PE), polypropylene (PP), polyethylene terephthalate (PET), polylactic acid (PLA), and/or the like, and/or combinations thereof. In yet another example, the substrate 12 may be formed from metal sheets and/or metal foils.

As previously mentioned, the ink receiving layer 14 is a porous layer formed, e.g., on the surface $S_1$ of the substrate 12. The ink receiving layer 14 absorbs an ink that is deposited or printed onto the medium 10. More specifically, the ink is deposited or printed onto the protective layer 16, passes through the pores 18 of the protective layer 16, and the ink vehicle is absorbed by the ink receiving layer 14, leaving the ink deposited on/in the ink receiving layer (as shown at reference numeral 26 in FIG. 4C, discussed further below).

The ink receiving layer 14 includes at least one pigment and a binder. Ink receiving layer 14 may also include one or more additives. The pigment for the ink receiving layer 14 may be chosen from pigments having a micro-porous structure and/or which may form a micro-porous structure as a result of aggregation of multiple particles. Some examples of pigments include silica (such as, e.g., fumed silica, colloidal silica, silica gels, and/or treated silicas), alumina, and zirconia. In an example, the pigment is chosen from silica, and the aggregate size of the silica particles ranges from about 20 nm to about 600 nm. In another example, the aggregate size of the silica particles ranges from about 100 nm to about 500 nm. In further examples, the Brunauer-Emmett-Teller (BET) surface area of the silica (such as fumed silica) ranges from about 100 $m^2/g$ to about 350 $m^2/g$; or from about 180 $m^2/g$ to about 300 $m^2/g$. The silica powders are pre-dispersed and accordingly, the zeta potential measurement used to measure the stability of the dispersion at a pH of from about 4 to about 5 is around +30 mV or higher.

Other examples of pigments that may be used for the ink receiving layer 14 include carbonates (e.g., calcium carbonates such as precipitated calcium carbonate, ground calcium carbonate, and treated calcium carbonate), clays (e.g., kaolin clays, calcined clays, engineered clays, and treated clays), talc, titanium dioxide, zeolites, calcium sulfate, aluminas, silicates, aluminum trihydrate (ATH), and combinations thereof. In an example, the pigment(s) is/are present in the ink receiving layer 14 in an amount ranging from about 50 wt % to about 95 wt % of the ink receiving layer 14.

The binder for the ink receiving layer 14 may be used in the layer 14 to hold the pigment particles together, as well as to adhere the pigment particles to the substrate 12. Some examples of the binder include natural and synthetic water soluble binders and natural and synthetic water dispersible binders. Some examples of binders include natural and chemically modified starches, gelatin, celluloses, acrylamide polymers, acrylic polymers, acrylic copolymers, vinyl acetate latex, vinyl acetate polymers and derivatives thereof (e.g., polyvinyl alcohol), polyesters, vinylidene chloride latex, styrene-butadiene copolymer latex, styrene/n-butyl acrylate copolymer, and/or acrylonitrile-butadiene copolymer latex. In an example, the amount of binder present ranges from about 3 wt % to about 40 wt % of the ink receiving layer 14.

Examples of additives that may be used in the ink receiving layer 14 include surfactants, humectants, cross-linking agents, and/or other processing aids such as pH buffers and defoamers. Examples of surfactant(s) include surfactant 10G (p-isononylphenoxy-polyglycidol) available from Arch Chemicals, Inc. (Norwalk, Conn.) and PLURON IC® L62 available from BASF Corp. (Ludwigshafen, Germany). Examples of humectants include glycerol, diethylene glycol mono butyl ether, and/or combinations thereof. The cross-linking agent may be used to cross-link the binders present in the ink receiving layer 14, and an example of the cross-linking agent includes boric acid.

In an example, the ink receiving layer 14 is a porous layer (e.g., the layer 14 includes pores having an effective pore diameter ranging from, e.g., the submicrometer range to about 500 nm), and as a porous layer, the ink receiving layer 14 can absorb ink vehicles of pigment-based or dye-based inks. In another example, the ink receiving layer 14 is a water swellable layer, and as a swellable layer, the ink receiving layer 14 can receive a dye-based ink, but not a pigment-based ink. In either case, the ink receiving layer 14 may have any suitable thickness. In an example, the ink receiving layer 14 thickness may range from about 5 μm to about 50 μm.

As shown in FIG. 1, the protective layer 16 is formed directly on the ink receiving layer 14, and when the medium 10 is manufactured, the layer 16 is formed as a porous layer. In other words, the layer 16 includes a plurality of pores 18, and an ink when printed onto the medium 10 passes through the pores 18 and is absorbed by the underlying ink receiving layer 14. In an example, the pores 18 individually have an effective pore diameter ranging from about 300 nm to about 1600 nm. It is believed that this pore size allows the pigment-based and/or dye-based inks to penetrate through the protective layer 16 as soon as the ink contacts the protective layer 16 during printing. In other words, when the ink contacts the protective layer 16, the ink does not remain, or remains for a minimal amount of time (e.g., less than 1 second) at the protective layer 16 after printing. Without being bound to any theory, it is believed that this minimal amount of time at the protective layer 16 helps to avoid image defects, e.g., ink bleeding and coalescence caused by undesirable ink migration at the surface of protective layer 16.

In an example, reactive polymer particles that are capable of cross-linking upon exposure to microwave radiation make up the bulk of the porous, protective layer 16. The reactive polymer particles are schematically illustrated at reference number 17 in FIGS. 1, 2, 4A and 4B (noting that only a few particles 17 are schematically shown, for ease of illustration). The polymer particles are chosen from those that are generally non-deformable, and have a relatively large particle size and a substantially narrow particle size distribution. As used herein, non-deformable (rigid) particles include those that have a high Young's modulus (e.g. ranging from about 600 MPa to about 3000 MPa) that allows the particles to resist deformation, collapsing, and/or filming/coalescing under manufacturing conditions and under inkjet printing conditions. Examples of the non-deformable particles having a relatively large particle size and a substantially narrow particle size distribution range in size from about 0.2 μm to about 10 μm in diameter.

In an example, the size distribution is measured by the Laser Diffraction method using a Malvern Instrument (Malvern Instruments, Ltd., Worcestershire, UK), where the distribution D is defined as:

$$D = \frac{(D_{0.9} - D_{0.1})}{D_{0.5}} \quad \text{(Equation 1)}$$

where 90% of the volume distribution is below $D_{0.9}$; 10% of the volume distribution is below $D_{0.1}$; and 50% of the volume distribution is below $D_{0.5}$. In an example, the particle size distribution D ranges from about 0.75 to about 1.25. It is believed that when the particle size distribution D falls within this range, the polymer particles 17 may form a geometrically regular array when deposited on the surface of the ink receiving layer 14, thereby leaving a significant amount of pores 18 in the packed structure of the protective layer 16.

Further, in another example, non-reactive polymer particles 17' may also be included (or may alternately be included, instead of reactive polymer particles 17) in the protective layer 16 (noting that only a few particles 17' are schematically shown in the figures, for ease of illustration). Examples of non-reactive polymer particles 17' include polymers/copolymers formed by polymerization and/or copolymerization of hydrophobic addition monomers. Examples of hydrophobic addition monomers include, but are not limited to, $C_1$-$C_{12}$ alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), and aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic acid containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomer, $C_1$-$C_{12}$ alkyl acrylamide and methacrylamide (e.g., t-butyl acrylamide, sec-butyl acrylamide, N,N-dimethylacrylamide), styrene, and olefin monomers (e.g., ethylene, propylene).

Examples of non-reactive polymer particles 17' may also include other particles made from, for example, polytetrafluoroethylene (PTFE), silica, silicone, paraffin wax, carnauba wax, montan wax, and combinations thereof.

In an example, non-reactive polymer particles 17' have the same high Young's modulus, same particle size and narrow particle size distribution as reactive polymer particles 17.

Both reactive polymer particles 17 and non-reactive polymer particles 17' are generally physically stable from room temperature (e.g., from about 18° C. to about 25° C.) to a manufacturing temperature (e.g., a temperature used for drying, from about 90° C. to about 110° C.).

In addition to being dimensionally stable, both the non-reactive polymer particles 17' and the reactive polymer particles 17 are chemically stable under manufacturing conditions and end use printing conditions, such that chemical reactions are not generated between adjacent particles 17, between adjacent particles 17, 17', nor between adjacent particles 17' (under manufacturing conditions and end use printing conditions).

At temperatures above 110° C., or under standard microwave radiation, the structure of the reactive polymer particles 17 tends to collapse and becomes chemically reactive. In this state, the polymer particles 17 will cross-link to form a continuous, non-porous/substantially non-porous film (e.g., shown at reference numeral 22 in FIG. 4C, and the formation of the film 22 will be described in further detail below).

Further, at temperatures above 110° C., or under standard microwave radiation, the non-reactive polymer particles 17' will coalesce to form the continuous, non-porous/substantially non-porous film 22.

In examples of the present disclosure, the polymer particles 17, 17' are in an emulsified state (e.g., particles 17, 17' are emulsified in water and/or in other solvents (e.g., pentanol, cyclohexanol, etc.)).

The reactive polymer particles 17 selected for the protective layer 16 are generally not limited, as long as macromolecular chains including particles 17 are capable of the cross-linking reaction mentioned above. Some examples of polymer particles for the protective layer 16 include particles of a polymer having an epoxy functionality on a backbone of the polymer, particles of a polymer having an epoxy functionality on a side chain of the polymer, particles of a polymer having fatty acid groups, particles of a polymer having alkoxy-silane groups, particles of a polymer having acetoacetoxy groups, particles of a polymer having hydroxyl groups, particles of a polymer having amine groups, and particles of a polymer having carboxyl groups.

Some examples of emulsions including reactive particles 17 include, but are not limited to XZ 92598, XZ 923646, and XZ 92533, all of which are available from the Dow Chemical Co., Midland, Mich.; BUTONAL® NS104, BUTONAL® NS125, BUTONAL® NS131, and BUTONAL® NS175, all of which are available from BASF Corp., Florham Park, N.J.; and CoatOsil™ 1770, available from Momentive Inc., Albany, N.Y.). In further examples, the polymer particles 17 are in acrylic emulsions, which tend to have desirable durability for media purposes. Some examples of commercially available acrylic emulsions include those of the Carbocure™ TSR series (such as Carbocure™ TSR-72, Carbocure™ TSR-92, Carbocure™ TSR-201) available from The Lubrizol Corporation, Wickliffe, Ohio; Carbocure™ 652, also available from The Lubrizol Corporation; HYCAR® 26315, also available from The Lubrizol Corporation; RAYCAT® 78 and RAYCAT® 29033, both available from Specialty Polymers, Inc., Woodburn, Oreg.

In an example, the protective layer 16 (including reactive polymer particles 17, or non-reactive polymer particles 17', or a mixture of reactive and non-reactive polymer particles 17, 17') may further include a polymeric binder. It is to be understood that any suitable polymeric binder may be used for the protective layer 16. Some examples of polymeric binder suitable for use in the protective layer 16 include water-dispersible and water-soluble polymeric compounds, such as polyvinyl alcohol, starch derivatives, gelatin, cellulose derivatives, acrylamide polymers, acrylic polymers or copolymers, vinyl acetate latex, polyesters, vinylidene chloride latex, styrene-butadiene, acrylonitrile-butadiene copolymers, styrene acrylic copolymers, and copolymers and/or combinations thereof.

Microwave radiation suitable for use in the present disclosure ranges in frequency from about 300 MHz (0.3 GHz) to about 300 GHz. In another example, the microwave radiation ranges from about 1.0 GHz to about 15 GHz. The medium 10, 10' having the ink deposited on the ink receiving layer 14 with the protective layer 16 thereover is exposed to the microwave radiation for any length of time suitable to form the protective film 22. In an example, the microwave exposure ranges from about 10 seconds to about 4 minutes.

It has been found that, during microwave curing of the layer 16, the microwave field exerts a force on the polymer particles 17, 17' and/or cross-linking agents (if present) in the protective layer 16. This force may cause dipole relaxation, where the particles turn or rotate with some lag when the direction of the microwave field changes at high frequencies. In some cases, energy (e.g., Joule energy) may be given off by the particles during microwave curing, and the particles will heat up at least by increases in the movement (e.g., rotation) of the polymer particles 17, 17'.

One way to strengthen dipole relaxation, and thus the molecular vibration effect, is to incorporate polar molecules into the protective layer 16 that will act as microwave radiation cure promoter(s). Examples of microwave radiation cure promoters for use herein include organic or inorganic electrolytes. These polar molecules may be polymeric macromolecules of the polymer protective layer 16, or other organic polymeric molecules such as, e.g., anionic conductive polymers and cationic conductive polymers. An example of a microwave radiation cure promoter which also serves as a binder is MOWIOL® 40-88, which is a polyvinyl alcohol available from Kuraray America, Inc., Pasadena, Tex. In another example, when a cationic conductive polymer is chosen as the microwave radiation cure promoter, it may also serve as an ink fixing agent when anionically-charged inks are printed on the medium 10.

Some examples of inorganic electrolyte microwave radiation cure promoters include inorganic electrolytes having anions chosen from hydroxide ions, oxide ions, nitrate ions, nitrite ions, sulfide ions, sulfate ions, sulfite ions, phosphate ions, polyphosphate ions, pyrophosphate ions, fluoride ions, chloride ions, bromide ions, iodide ions, astatide ions, pyrosulfate ions, pyrosulfite ions, carbonate ions, tetrafluoroborate ions, hydrogen sulfate ions, hydrogen sulfite ions, hydrogen phosphate ions, dihydrogen phosphate ions, and/or the like. Cations for the inorganic electrolyte may be chosen from any metal from Groups I, II, and III in the periodic table of elements, as well as all transition metals. Some examples of metal cations for the promoter include sodium, potassium, calcium, copper, nickel, zinc, magnesium, barium, iron, aluminum, and chromium ions. Examples of inorganic electrolyte microwave radiation cure promoters include calcium sulfate hemihydrates and sodium silicate.

In some cases, the microwave radiation cure promoter may be chosen from water soluble organic acids, and the water soluble metal salts thereof. The molecular formula of an example of a water soluble organic metal salt is $(C_nH_{2n+1}COO^-M^+)^*(H_2O)_m$, where n is a whole number ranging from 1 to 8 (or in a further example, from 1 to 4), M is a metal chosen from Group I, Group II, Group III, and transition metals in the periodic table of elements, and m is a whole number ranging from 1 to 12. In some instances, the salt may not include hydrated water molecules, and in these instances, m is zero. Some examples of organic acid salts include calcium acetate monohydrate, calcium propionate, and calcium propionate hydrate.

Figure 2:
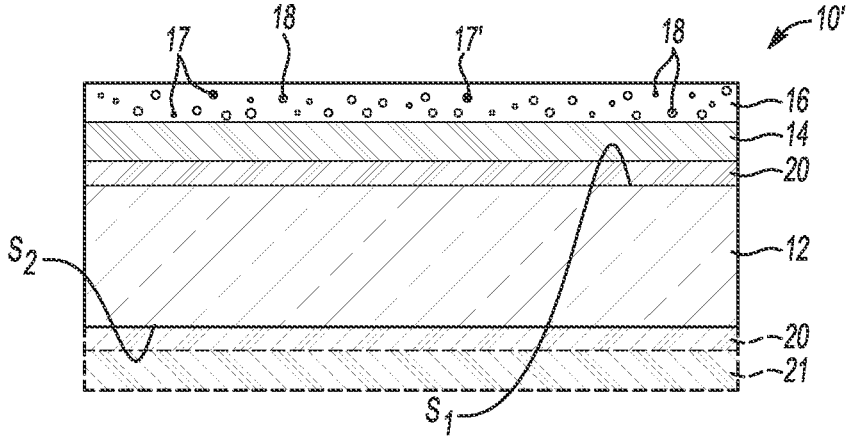
FIG. 2 is a schematic cross-sectional view (which is also not drawn to scale) of another example of an inkjet recording medium according to the present disclosure.

Another example of the inkjet recording medium 10' is schematically depicted in FIG. 2. In this example, the medium 10' includes the substrate 12, a coating layer 20 formed on the surface $S_1$ of the substrate 12, the ink receiving layer 14 formed on the coating layer 20, and the protective layer 16 formed on the ink receiving layer 14. The substrate 12, the ink receiving layer 14, and the protective layer 16 of the inkjet recording medium 10' in the example depicted in FIG. 2 are the same as those for the example of the inkjet recording medium 10 in FIG. 1.

In one example, the coating layer 20 for the medium 10' is a polyolefin film formed on the substrate surface $S_1$. Any material from the polyolefin family may be used as the coating layer 20. In an example, the polyolefin for the coating layer 20 may be chosen from high density polyethylene, low density polyethylene, linear low density polyethylene, copolymers of polyethylene, polypropylene, copolymers of polypropylene, and combinations thereof. In another example, the layer 20 may also be applied to the surface $S_2$ opposite from the surface $S_1$. The layer 20 (formed on the surface $S_1$ alone, or on both of the surfaces $S_1$ and $S_2$) may be used to provide or otherwise impart a photo feel (e.g., a silver halide (AgX) feel) and durability to the medium 10'.

In an example, the medium 10' may further include a back layer 21 formed on the coating layer 20 that is formed on the substrate surface $S_2$. The back layer 21 may be used to produce a photo feel, and to promote flatness to the sheet. In an example, the back layer 21 may include a resin, or may include a resin and a pigment. Back layer 21 resins may be synthetic resins and/or natural resins. Examples of synthetic polymeric resins include polyvinyl alcohol, polyvinyl pyrrolidone, acrylic latex, styrene-butadiene latex, polyvinyl acetate latex, a copolymer latex of monomers of any of the above-named polymers, and combinations or mixtures thereof. Examples of natural polymeric resins include casein, soy protein, polysaccharides, cellulose ethers, alginates, virgin starches, modified starches, and combinations of any of the above named natural polymers. Examples of back layer 21 pigments include ground calcium carbonate, precipitated calcium carbonate, titanium dioxide, kaolin clay, silicates, plastic pigments, alumina trihydrate, and combinations thereof.

In another example, the back layer 21 may be formed from the same composition as coating layer 20.

It is to be understood that the back layer 21 may also be used for the medium 10 of FIG. 1. In this case, the back layer 21 may be formed directly on the surface $S_2$ of the substrate 12.

In another example, the back layer 21 may be formed on the coating layer 20, which is formed directly on the surface $S_2$, with no coating layer 20 being formed on the surface $S_1$ of the substrate 12.

The inkjet recording medium 10 may be made by forming (e.g., coating or depositing) the ink receiving layer 14 on the substrate 12 (such as on the surface $S_1$), and then (or simultaneously) forming (e.g., coating or depositing) the protective layer 16 on the ink receiving layer 14. The ink receiving layer 14 may be applied on the substrate 12 using any suitable method, such as rod coating, film transfer coating, blade coating, gravure coating, air knife coating, slot die coating, and/or curtain coating. In an example, curtain coating is used to coat the layer 14 on the substrate 12 at a rate ranging from about 200 m/min to about 300 m/min.

The protective layer 16 may be applied over the ink receiving layer 14 using a suitable method. Some examples of suitable methods include a wet-on-wet method or a wet-on-dry method. An example of a wet-on-wet process generally involves simultaneously applying the ink receiving layer 14 and the protective layer 16 to the substrate 12, where the liquid compositions of layers 14, 16 exist in a layered structure by suitable surface tension without mixing together during coating. As such, a structure having two distinct layers 14, 16 can be formed. The wet-on-wet method can be accomplished by coating methods such as, e.g., slot die coating and curtain coating. After application of layers 14, 16, the medium 10, 10' is then dried.

An example of a wet-on-dry process generally involves applying the ink receiving layer 14 is to the substrate surface $S_1$. The ink receiving layer 14 is then dried. A space occupying layer (not shown) is then applied on the dried ink receiving layer 14 before the protective layer 16 is applied, so that the protective layer 16 will not be absorbed into the pores of the ink receiving layer 14, and therefore two distinct layers 14, 16 can be formed. The space occupying layer may be any composition capable of occupying the ink receiving layer 14 pores and being volatile under protective layer 16 drying conditions. In an example, the space occupying layer composition is water. The space occupying layer may be applied over the ink receiving layer 14 via any suitable process, including but not limited to a metered-size press, a puddle-size press, roll-coating, conventional slot-die processing, blade coating, slot-die cascade coating, curtain coating, rod coating, and/or gravure air knife coating. In some instances, spray-coating, immersion-coating, and/or cast coating techniques may also be used.

The protective layer 16 is then applied on the ink receiving layer 14. The protective layer 16 may be applied by any suitable method, e.g., by any of the methods disclosed herein, including rod coating, film transfer coating, blade coating, gravure coating, air knife coating, slot die coating, curtain coating, etc. Since the pores of the ink receiving layer 14 are occupied, the protective layer 16 does not penetrate into the pores of the underlying ink receiving layer 14. The medium 10 is then dried, and the space occupying layer evaporates, thus leaving the ink receiving layer 14 porous again with the protective layer 16 formed as a discrete layer 16 over the ink receiving layer 14. It is to be understood that any suitable drying methods may be used, including, e.g., forced hot air, Infrared (IR) dryers, or the like. In an example, the drying temperature ranges from about 110° C. to about 140° C.

The inkjet recording medium 10' of FIG. 2 may be made by forming (e.g., coating) the coating layer 20 on the substrate 12 (such as on the surface $S_1$ alone, or on both surfaces $S_1$ and $S_2$), and then forming (e.g., coating) the ink receiving layer 14 on one or both of the coating layers 20 (e.g., on the coating layer 20 formed on the surface $S_1$ or on both surfaces $S_1$ and $S_2$), and the protective layer 16 on the ink receiving layer 14. It is noted that the coating layer 20 is dried before the ink receiving layer 14 and the protective layer 16 are applied. It is to be understood that the ink receiving layer 14 and protective layer 16 may be applied to the coating layer 20 by any suitable process, e.g., either of the wet-on-dry or wet-on-wet processes described above. In an example, the back layer 21 may be formed on the coating layer 20 formed on the surface not including the ink receiving layer 14 and the protective layer 16, such as on the surface $S_2$. The formation of the coating layer(s) 20 and back layer 21 may be accomplished using any suitable deposition method, e.g., such as any of the coating methods described above.

An example of a method for using the inkjet recording medium 10, 10' will be described herein in conjunction with FIG. 3 and with FIGS. 4A through 4C. The method includes printing an ink onto the medium 10, 10' having the porous protective layer 16 thereon. The ink penetrates through the porous protective layer 16 and into/on the ink receiving layer 14 (schematic examples of ink absorbed by the ink receiving layer 14 are designated at reference numeral 26) to form a print 23 with black and/or color images (see FIG. 4B and also reference numeral 300 in FIG. 3). The ink to be printed is an inkjet ink, and may be chosen from a pigment-based ink and/or a dye-based ink, and these inks may be aqueous-based inks, solvent-based inks, and/or latex-based inks. In an example, the ink may be chosen from any inkjet ink available from Hewlett-Packard Co. (Palo Alto, Calif.).

The ink may be printed using an inkjet printing system or printer (not shown), such as a continuous inkjet printer, a drop-on-demand inkjet printer, a thermal inkjet (TIJ) printer, or a piezoelectric inkjet printer. In an example, the ink may be contained in an ink reservoir inside the printer, and the ink may be retrieved from the reservoir and printed via a fluid ejector during inkjet printing. The ink is deposited onto the medium 10, 10' (i.e., directly onto the protective layer 16) during printing, and the ink vehicle is absorbed by the ink receiving layer 14, leaving the ink dyes/pigments deposited on/in ink receiving layer 14 to form the print 23, as mentioned above.

Figure 4A:
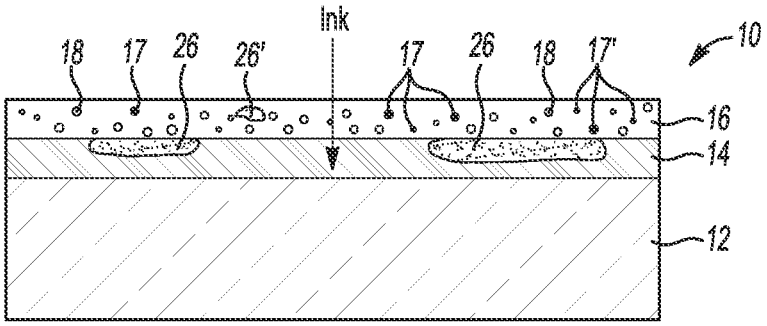
FIGS. 4A through 4C, together, schematically illustrate the example of the method of using examples of the inkjet recording medium of FIG. 3, where the protective layer of the inkjet recording medium is converted from a porous state (FIG. 4A) to a non-porous/substantially non-porous state (FIG. 4C).
Figure 4B:
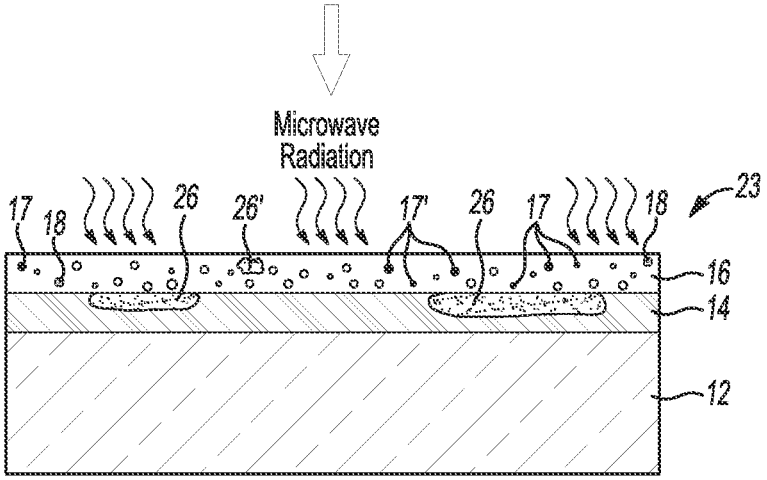

It is to be understood that, in some instances, a portion of the ink may remain in the protective layer 16, as shown by the portion(s) of ink labeled 26' in protective layer 16 in FIGS. 4A and 4B.

Figure 3:
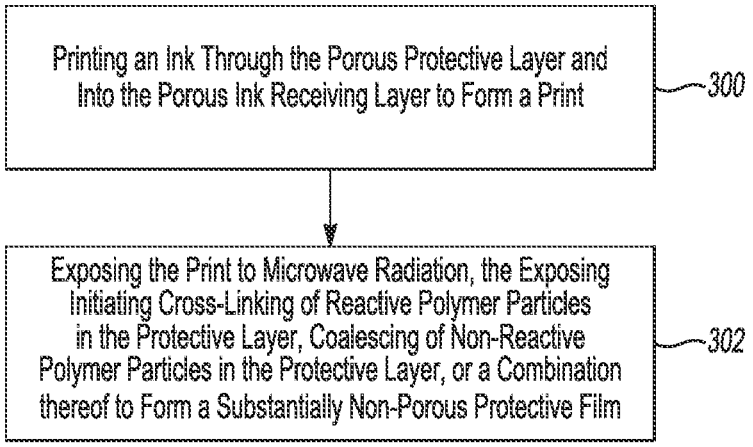
FIG. 3 is a flow diagram depicting an example of a method of using examples of the inkjet recording medium.
Figure 4C:
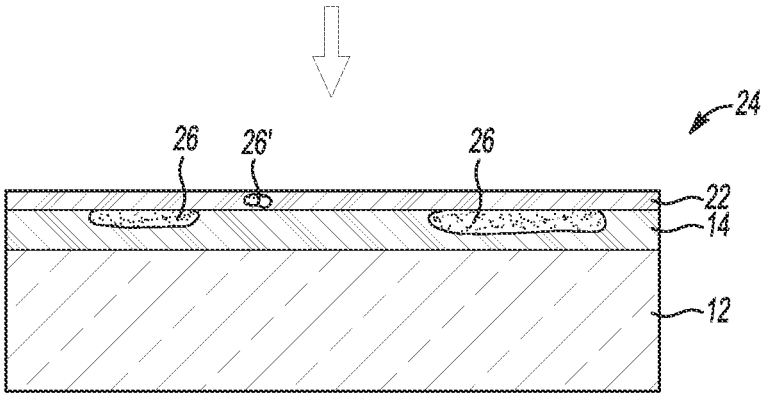

The method of using the medium 10, 10' further includes exposing the print 23 to microwave radiation (see FIG. 4B), where the exposing initiates cross-linking of the reactive polymer particles 17 and/or coalescing of the non-reactive polymer particles 17' in the protective layer 16 to form a continuous, substantially non-porous/non-porous protective film 22 (see FIG. 4C and also reference numeral 302 in FIG. 3). Further, it is to be understood that by "substantially non-porous", it is meant that the volume of film 22 contains less than about 30%, or less than about 20% pores. In an example, the volume of film 22 may contain 0% pores, and thus would be considered non-porous.

After the microwave radiation exposing, in instances where a portion of the ink 26' remained in the protective layer 16, those portions of ink 26' may be physically interlocked in the cured protective film 22, as shown in FIG. 4C.

In an example, the microwave radiation may be generated from a microwave device (not shown) that is part of, or incorporated into the printer downstream from the fluid ejector. In this configuration, the medium 10, 10' is fed into the printer, and an ink is printed on the medium 10, 10' via the fluid ejector. After printing, the medium 10, 10' is fed into the microwave device, where microwave curing of the protective layer 16 occurs before the medium 10, 10' is delivered to a print tray. In some cases, it may be desirable to dry the ink 26 printed on the medium 10, 10' (via, e.g., an online dryer or the like) in a mild heated environment, e.g., at a temperature ranging from about 50° C. to about 80° C. to remove excess ink vehicle from the medium 10, 10' before exposing the print 23 to microwave radiation. The microwave device could also be separate from the printer, and the print 23 may be introduced to the separate microwave device by any suitable process.

When reactive polymer particles 17 are incorporated in protective layer 16, the microwave radiation applied to the medium 10, 10' initiates a macromolecular, chemical reaction between polymer macromolecular chains that are made up of the reactive polymer particles 17 of the porous protective layer 16. This macromolecular reaction is a reaction that occurs between and/or among the polymer chains having a high weight average molecular weight, e.g., ranging from about 13,000 to about 400,000, and not between and/or among the smaller monomers or oligomers. This macromolecular reaction is, for example, a cross-linking reaction that is effected by i) the reaction between the polymer chains following inter-diffusion; and ii) cross-linking at interfaces of the polymer particles. It is believed that the chemical reactions that occur between the polymer chains following inter-diffusion form a coherent, continuous film (such as the film 22 shown in FIG. 4C). Since cross-linking occurs between the polymer chains, the molecular weight of the chains increases. Further, the cross-linking at interfaces of the polymer particles causes adjacent particles to chemically bind to each other by cross-linking during or just after film formation. It is believed that chemically binding adjacent reactive polymer particles 17 may affect various properties of the film 22, such as entanglement between polymer chains. While being exposed to microwave radiation, the cross-linking reaction may be completed within a relatively short time frame, such as from several seconds to less than 5 minutes.

The thickness of the protective film 22 (i.e., the protective layer 16 after curing) is less than that of the porous protective layer 16. In an example, the protective film 22 is about 40% thinner than the protective layer 16. In another example, the protective film 22 is from about 50% to about 70% thinner than the protective layer 16. A higher reduction in thickness of the protective film 22 in some instances renders a smoother surface and good print quality performance (e.g., improved gloss and good distinctness of image (DOI)).

In an example, cross-linking may be initiated by a chemical reaction between macromolecular chains with small molecular cross-linking agents (disposed within the protective layer 16) having a molecular weight of less than about 500 atomic mass units (AMU). Each cross-linking agent has at least two reactive functional groups present in the protective layer 16 composition. The cross-linking agent in the protective layer 16 bridges the macromolecular chains to form a network. In another example, a self-cross-linkable polymer may be used without having to add a cross-linking agent, and the cross-linking reaction may be initiated, for example, by the evaporation of water during exposure to the microwave radiation.

Additionally, it is believed that the microwave radiation accelerates cross-linking, at least in part by effectively deblocking functional groups, and increasing the kinetics (e.g., the reaction rate) toward cross-linking. Examples of some cross-linking systems that may be used include the reaction of amines with polymer chains having an epoxy functionality on the polymer backbone or on a side chain, the oxidation of fatty acid groups incorporated into the polymer, self-condensation of alkoxy-silane groups, self-condensation of methyl-acrylamide metal-ion coordination with functional groups (e.g., acetoacetoxy groups or acid groups) on the backbone of the polymer, and the reaction of acetoacetoxy groups with amine or acetoacetoxy groups with unsaturated groups.

After microwave curing, the final print 24 includes the continuous, substantially non-porous film 22/non-porous film 22 that covers the deposited/printed ink 26 on the ink receiving layer 14, as shown in FIG. 4C. The protective film 22 may, in an example, have a thickness that ranges from about 0.1 μm to about 3 μm. In another example, the thickness of the film 22 ranges from about 0.1 μm to about 1.5 μm.

To further illustrate the present disclosure, examples are given herein. It is to be understood that these examples are provided for illustrative purposes and are not to be construed as limiting the scope of the disclosed example(s).

EXAMPLES

Example 1

Six sample mediums were prepared (i.e., Samples A, B, C, D, E, and F), where samples A, C, and E respectively included different compositions of a protective layer formed on an ink receiving layer, where the protective layer had a coat weight of about 1 gsm. The ink receiving layer was formed on a polyethylene co-extruded cellulose paper substrate. Samples B, D, and F respectively also included different compositions of the protective layer, which had a coat weight of about 3 gsm. A comparative sample was also prepared that included an ink receiving layer formed on the same type of substrate as used with samples A-F, but did not include a protective layer. The protective layer of Sample mediums A and B each included about 93 wt % of HYCAR® 26135, the protective layer of Sample mediums C and D each included about 93 wt % of RAYCAT® 78, and the protective layer of sample mediums E and F each included about 93 wt % of RAYCAT® 29033. Each of the sample mediums A, B, C, D, E, and F also included about 7 wt % of MOWIOL® 40-88 as a binder, and ammonium hydrogen sulfate ($NH_4HSO_4$) as a microwave curing promoter.

A number of prints were prepared utilizing the sample mediums A, B, C, D, E, and F by printing different colored inks on each of the mediums. After printing, sample mediums A-F were exposed to microwave radiation using a standalone Panasonic NNSD697S countertop microwave with 1300 W of power. The exposure to the microwave radiation occurred for about 90 seconds. The gloss (as well as durability and distinctness of image (DOI); results shown in further examples below) was measured for each print about 12 hours after the prints were exposed to the microwave radiation. As shown in Table 1 below, the gloss was measured for each print formed by printing a black ink (K), a cyan ink (C), a magenta ink (M), a yellow ink (Y), a red ink (R), a green ink (G), and a blue ink (B) on different sheets of each sample medium. The gloss was also measured for each of the sample mediums A, B, C, D, E, and F without an ink being printed thereon (W). The gloss was measured at 20 degrees using a micro-Tri-Gloss meter available from BYK Gardiner, and the measurements of the gloss are set forth in Table 1 below:

TABLE 1

Gloss measurements for prints formed from sample mediums A, B, C, D, E, and F with different colored inks

| Sample | W | K | C | M | Y | R | G | B |
|---|---|---|---|---|---|---|---|---|
| Comparative Sample | 4.2 | 27.5 | 13.1 | 18.2 | 16.5 | 15.8 | 12.8 | 17.2 |
| Sample A | 27.4 | 37.8 | 25.1 | 29.6 | 32.5 | 25.2 | 17.1 | 17.3 |
| Sample B | 25.2 | 34.5 | 16.4 | 26.8 | 30.7 | 25.9 | 16.5 | 19.3 |
| Sample C | 11.2 | 41.1 | 23.9 | 24.8 | 29.3 | 17.3 | 16.7 | 19.5 |
| Sample D | 23.4 | 39.2 | 18.7 | 25.7 | 29.6 | 26.3 | 17.7 | 19.4 |
| Sample E | 27.4 | 40.8 | 19.1 | 25.1 | 27.8 | 23.3 | 14.6 | 19.3 |
| Sample F | 28.2 | 40.5 | 24.2 | 25.7 | 26.7 | 24.8 | 17.2 | 21.4 |

As shown in Table 1 above, it was found that the gloss number was notably higher for the samples containing a protective layer when no ink was printed on the respective mediums (e.g., the lowest gloss number obtained was 11.2 for Sample Medium C) compared to the comparative sample that did not include a protective layer (e.g., the gloss number obtained for the comparative sample was 4.2).

Further, each of the sample mediums having an ink printed thereon exhibited a much higher gloss compared to the comparative sample, which again included no protective layer. It was also found that for many of the sample mediums, a gloss number greater than about 20 was achieved (e.g., a print formed by printing a magenta ink on any of the samples A, B, C, D, E, and F), which means that the gloss for these prints renders such prints as being as good as photobase paper.

Example 2

Each of the Sample Mediums A, B, C, D, E, and F were also tested to determine their durability, such as their resistance to wet rub. An Ink Rub Tester from Testing Machines, Inc. was used to perform the wet rub test. The procedure included placing about 50 μL of water on a number of color squares for a period of time (e.g., about 30 seconds). Then, rubbing was performed using a 2 pound sled for about 10 cycles, and the prints were afterwards allowed to rest. After about 2 hours, the prints were evaluated for rub resistance, and ranked according to the evaluation. A ranking or score of 1 indicates that the print was not desirably resistant to rubbing, whereas a ranking or score of 5 indicates that the print is very resistant to rubbing. The results of the wet rub test are summarized in Table 2 below:

TABLE 2

Wet rub results for prints formed from sample mediums A, B, C, D, E, and F

| Sample | Wet Rub Ranking |
|---|---|
| Comparative Sample | 1 |
| Sample A | 4 |
| Sample B | 3 |
| Sample C | 4 |
| Sample D | 4 |
| Sample E | 4 |
| Sample F | 4 |

As shown in Table 2 above, the prints formed from samples A, B, C, D, E, and F exhibited much better resistance to wet rub (i.e., where an average ranging is about 4) than the comparative sample (i.e., which had a ranking of 1).

Example 3

Each of the Sample Mediums A, B, C, D, E, and F were further tested to determine their resistance to dry rub. In this test, the Ink Rub Tester from Testing Machines, Inc. was also used to perform the dry rub test. The procedure included rubbing each color square printed on each of the sample mediums and on the comparative sample using a 2 pound sled for about 10 cycles, and the prints were afterwards allowed to rest. After about 2 hours, the prints were evaluated for dry rub resistance, and ranked according to the evaluation. A ranking or score of 1 indicates that the print was not desirably resistant to rubbing, whereas a ranking or score of 5 indicates that the print is very resistant to rubbing. The results of the dry rub test are summarized in Table 3 below:

TABLE 3

Dry rub results for prints formed from sample mediums A, B, C, D, E, and F

| Sample | Dry Rub Ranking |
|---|---|
| Comparative Sample | 1 |
| Sample A | 5 |
| Sample B | 4 |
| Sample C | 5 |
| Sample D | 4 |
| Sample E | 5 |
| Sample F | 4 |

As shown by the results in Table 3, all of the sample mediums (i.e., A, B, C, D, E, and F) exhibited good or very good resistance to dry rub, and were all much more resistant to dry rub than was the comparative sample. The results also show that the mediums having a lighter coat weight of the protective layer (i.e., samples A, C, and E) showed somewhat better resistance to dry rub than the samples having a heavier coat weight of the protective layer (i.e., samples, B, D, and F).

Example 4

Prints were also formed from sample mediums A, B, C, and D, and these prints were tested to determine their distinctness of image (DOI) utilizing a DIAS™ (Distinctness-of-Image Analysis System) available from QEA Company. The DOI measurement was made by projecting a sharp edge onto a surface, and capturing a reflected image (as a digitized image) using a solid state area or line sensor. From the digitized image, a reflectance profile was obtained and analyzed to obtain a measure of the DOI of the sample being tested. The results of the DOI test are shown in Table 4 below. It is noted that a higher DOI value refers to a better distinctness of the image. For example, in photo print applications, a DOI above 3.0 is generally considered acceptable.

TABLE 4

DOI measurement for prints formed utilizing sample mediums A, B, C, and D

| Sample | DOI |
|---|---|
| Comparative Sample | 3.2 |
| Sample A | 3.8 |
| Sample B | 3.5 |
| Sample C | 3.2 |
| Sample D | 3.4 |

The results of the DOI test show that the distinctness of images formed on the sample mediums is substantially the same as those formed on the comparative sample. In other words, the desirable DOI may still be achieved even with the presence of the protective film.

Examples of the final print 24 as disclosed herein exhibit good print quality, for example, improved gloss, good distinctness of image (DOI), improved wet and dry rub resistance, and improved fade resistance, as compared to printed media similar to that described in examples disclosed herein, but without the microwave cured protective film 22 thereon.

It is to be understood that the ranges provided herein include the stated range and any value or sub-range within the stated range. For example, a range from about 0.1 μm to about 3 μm should be interpreted to include not only the explicitly recited limits of about 0.1 μm to about 3 μm, but also to include individual values, such as 0.1 μm, 1 μm, 2.4 μm, etc., and sub-ranges, such as from about 0.5 μm to about 1.5 μm, from about 0.75 μm to about 2.8 μm, etc. Furthermore, when "about" is utilized to describe a value, this is meant to encompass minor variations (up to +/−5%) from the stated value.

While several examples have been described in detail, it will be apparent to those skilled in the art that the disclosed examples may be modified. Therefore, the foregoing description is to be considered non-limiting.

What is claimed is:

1. An inkjet recording medium, comprising:

a substrate having two opposed surfaces;

an ink receiving layer disposed on at least one of the two opposed substrate surfaces, the ink receiving layer to receive an ink when printed thereon; and a porous protective layer disposed on the ink receiving layer, the porous protective layer including:

a microwave radiation cure promoter to strengthen dipole relaxation and molecular vibration of reactive polymer particles upon exposure to microwave radiation; and the reactive polymer particles that participate in a cross-linking reaction upon exposure to the microwave radiation; or a combination of the reactive polymer particles and non-reactive polymer particles that are to coalesce upon exposure to microwave radiation, to form a substantially non-porous protective film to cover the printed ink.

2. The inkjet recording medium as defined in claim 1 wherein the substrate is chosen from a cellulose paper base, coated papers, papers including: polyethylene; polypropylene; polyethylene terephthalate; polylactic acid; or combinations thereof, metal sheets, metal foils, and combinations thereof.

3. The inkjet recording medium as defined in claim 1 wherein the porous protective layer reactive polymer particles and non-reactive polymer particles each exhibit a Young's modulus ranging from about 600 MPa to about 3000 MPa, and wherein the polymer particles have a particle size ranging from about 0.2 μm to about 10 μm in diameter.

4. The inkjet recording medium as defined in claim 3 wherein the porous protective layer further comprises a cross-linking agent.

5. The inkjet recording medium as defined in claim 1 wherein the ink receiving layer comprises at least one pigment and a binder.

6. The inkjet recording medium as defined in claim 1 wherein the reactive polymer particles and the non-reactive polymer particles are physically and chemically stable at a temperature less than about 110° C.

7. The inkjet recording medium as defined in claim 1 wherein the reactive polymer particles are chosen from: particles of a polymer having an epoxy functionality on a backbone of the polymer; particles of a polymer having an epoxy functionality on a side chain of the polymer; particles of a polymer having fatty acid groups; particles of a polymer having alkoxy-silane groups; particles of a polymer having acetoacetoxy groups; particles of a polymer having hydroxyl groups, particles of a polymer having amine groups; and particles of a polymer having carboxyl groups;

and wherein the non-reactive polymer particles are formed from: polymers formed by polymerization or copolymerization of hydrophobic addition monomers; polytetrafluoroethylene (PTFE); silica; silicone; paraffin wax; carnauba wax; montan wax; and combinations thereof.

8. The inkjet recording medium as defined in claim 1 wherein the microwave radiation cure promoter is chosen from inorganic polar molecules and organic polar molecules.

9. The inkjet recording medium as defined in claim 8 wherein the microwave radiation cure promoter is chosen from:

anionic conductive polymers;

cationic conductive polymers;

inorganic electrolytes having:

anions chosen from hydroxide ions, oxide ions, nitrate ions, nitrite ions, sulfide ions, sulfate ions, sulfite ions, phosphate ions, polyphosphate ions, pyrophosphate ions, fluoride ions, chloride ions, bromide ions, iodide ions, astatide ions, pyrosulfate ions, pyrosulfite ions, carbonate ions, tetrafluoroborate ions, hydrogen sulfate ions, hydrogen sulfite ions, hydrogen phosphate ions, dihydrogen phosphate ions, and combinations thereof; and cations chosen from sodium ions, potassium ions, calcium ions, copper ions, nickel ions, zinc ions, magnesium ions, barium ions, iron ions, aluminum ions, chromium ions, and combinations thereof;

water soluble organic acids, and water soluble organic metal salts thereof; and combinations thereof.

10. The inkjet recording medium as defined in claim 8 wherein the microwave radiation cure promoter is a water soluble organic metal salt having the formula $$(C_nH_{2n+1}COO^-M^+)^*(H_2O)_m$$

where n is a whole number ranging from 1 to 8, M is a metal chosen from Group I, Group II, Group III, and transition metals, and m is a whole number ranging from 0 to 12.

11. The inkjet recording medium as defined in claim 10 wherein the organic metal salt is chosen from calcium acetate monohydrate, calcium propionate, calcium propionate hydrate, and combinations thereof.

12. A method of using the inkjet recording medium of claim 1, the method comprising:

printing the ink through the porous protective layer and onto the ink receiving layer to form a print; and exposing the print to microwave radiation, the exposing initiating: a cross-linking reaction of the reactive polymer particles; or a combination of a cross-linking reaction of the reactive polymer particles and coalescing of the non-reactive polymer particles in the protective layer to form the substantially non-porous protective film.

13. The method as defined in claim 12 wherein the protective layer has a thickness ranging from about 0.1 μm to about 3 μm.

14. The method as defined in claim 12 wherein the microwave radiation has a frequency ranging from about 0.3 GHz to about 300 GHz, and wherein the print is exposed to the microwave radiation for an amount of time ranging from about 10 seconds to about 4 minutes.

15. A method of making an inkjet recording medium, comprising:

disposing an ink receiving layer on at least one of two opposed surfaces of a substrate, the ink receiving layer to receive an ink when printed thereon; and disposing a porous protective layer on the ink receiving layer, the porous protective layer including:

a microwave radiation cure promoter to strengthen dipole relaxation and molecular vibration of reactive polymer particles upon exposure to microwave radiation; and the reactive polymer particles that participate in a cross-linking reaction upon exposure to the microwave radiation; or a combination of the reactive polymer particles and non-reactive polymer particles that are to coalesce upon exposure to microwave radiation, to form a substantially non-porous protective film on the ink receiving layer, the protective film to cover the printed ink.

16. The inkjet recording medium as defined in claim 1 wherein the reactive polymer particles are chosen from: particles of a polymer having an epoxy functionality on a backbone of the polymer; particles of a polymer having an epoxy functionality on a side chain of the polymer; particles of a polymer having fatty acid groups; particles of a polymer having alkoxy-silane groups; particles of a polymer having acetoacetoxy groups; particles of a polymer having hydroxyl groups, particles of a polymer having amine groups; and particles of a polymer having carboxyl groups.

17. The inkjet recording medium as defined in claim 1 wherein the ink receiving layer is a porous layer.

18. The method as defined in claim 12 wherein the microwave radiation has a frequency ranging from about 1 GHz to about 15 GHz.

19. The inkjet recording medium as defined in claim 1 wherein the reactive polymer particles are a single type of reactive polymer particle chosen from a polymer that includes fatty acid groups that undergo oxidation and a polymer that includes alkoxy-silane groups that undergo self-condensation.

20. The inkjet recording medium as defined in claim 1 wherein the porous protective layer includes about 7 wt % of the microwave radiation cure promoter.

* * * * *